US012332038B2

(12) United States Patent
Yang et al.

(10) Patent No.: US 12,332,038 B2
(45) Date of Patent: Jun. 17, 2025

(54) EFFICIENT CUT BLASTING METHOD FOR MEDIUM-LENGTH HOLES IN DEEP HIGH-STRESS ROCK ROADWAY BASED ON CRUSTAL STRESS INDUCTION EFFECT

(71) Applicant: UNIVERSITY OF SCIENCE AND TECHNOLOGY BEIJING, Beijing (CN)

(72) Inventors: Renshu Yang, Beijing (CN); Chenxi Ding, Beijing (CN); Min Gong, Beijing (CN); Desheng Wang, Beijing (CN); Songlin He, Beijing (CN); Chenglong Xiao, Beijing (CN); Shuai You, Beijing (CN); Wen Chen, Beijing (CN)

(73) Assignee: UNIVERSITY OF SCIENCE AND TECHNOLOGY BEIJING, Beijing (CN)

( * ) Notice: Subject to any disclaimer, the term of this patent is extended or adjusted under 35 U.S.C. 154(b) by 56 days.

(21) Appl. No.: 18/342,369

(22) Filed: Jun. 27, 2023

(65) Prior Publication Data

US 2023/0417526 A1 Dec. 28, 2023

(30) Foreign Application Priority Data

Jun. 28, 2022 (CN) ..... 202210743419.0

(51) Int. Cl.
*F42D 1/08* (2006.01)
*F42D 3/04* (2006.01)

(52) U.S. Cl.
CPC ..... *F42D 1/08* (2013.01); *F42D 3/04* (2013.01)

(58) Field of Classification Search
CPC ..... F42D 1/08; F42D 3/04
See application file for complete search history.

(56) References Cited

U.S. PATENT DOCUMENTS 3,902,422 A 9/1975 Coursen

FOREIGN PATENT DOCUMENTS

| | | | |
|---|---|---|---|
| CN | 102997768 | A | 3/2013 |
| CN | 104457465 | A | 3/2015 |
| CN | 107631669 | A | 1/2018 |
| CN | 111102892 | A | 5/2020 |
| CN | 111692931 | A | 9/2020 |
| RU | 2627349 | C1 | 8/2017 |

OTHER PUBLICATIONS

The First Chinese Office Action dated Feb. 8, 2023; Appin #202210743419.0 (No English Abstract).

(Continued)

*Primary Examiner* — Sunil Singh
(74) *Attorney, Agent, or Firm* — Frank Gao, Esq.

(57) ABSTRACT

An efficient cut blasting method for medium-length holes in deep high-stress rock roadway is disclosed. The method may comprise steps of carrying out a crustal stress blasting test on the free face of the in-situ rock roadway to be excavated, and obtaining a distribution state of cracks under a synergistic action of crustal stress, explosion stress waves and clamping force of surrounding rock of a rock mass in the stratum where the in-situ rock roadway to be excavated is located; arranging a cutting hole net on the free face of the rock roadway to be excavated according to a distribution state of the cracks; performing cut blasting based on the cutting hole net.

7 Claims, 8 Drawing Sheets

(56) References Cited

OTHER PUBLICATIONS

The First Chinese Office Action dated Feb. 8, 2023; Appln #202210743419.0.
Notification of grant dated Jun. 1, 2023, Appln No. 202210743419.0.
Meng Chengpu, A Study of Influence Factors of Rock Mass under Blasting Load, J. of Anhui University of Technology(Natural Science), vol. 33 No. Apr. 2, 2016 , p. 160-166, Anhui, China.

EFFICIENT CUT BLASTING METHOD FOR MEDIUM-LENGTH HOLES IN DEEP HIGH-STRESS ROCK ROADWAY BASED ON CRUSTAL STRESS INDUCTION EFFECT

This application claims the priority of the Chinese patent application filed on Jun. 28, 2022, with the application number of 202210743419.0, titled 'Efficient cut blasting method for medium-length holes in deep high-stress rock roadway based on crustal stress induction effect', the entire contents of which are incorporated herein by reference.

TECHNICAL FIELD

The present application relates to the field of drilling and blasting excavation in deep rock mass, in particular to an efficient cut blasting method for medium-length holes in deep high-stress rock roadway based on crustal stress induction effect.

BACKGROUND TECHNOLOGY

In recent years, the mining status of mineral resources has changed from open-air to underground, from shallow to deep. Among them, the mining depth of coal has reached 1500 m, the mining depth of geothermal and non-ferrous metals has exceeded 3000 m and 4350 m respectively, and the mining depth of oil and gas resources even has reached 7500 m. Deep mining will become the norm and is one of the main ways to ensure the supply of energy and mineral resources in China. As resource mining marches into the depths of the earth, the resource mining environment becomes more complex, and the difficulty of mining increases sharply. The deep mining of mineral resources is faced with 'three highs and one disturbance'. Among them, the characteristics of high crustal stress of deep rock mass is a significant difference between deep mining and shallow mining, and it is also a difficult problem that deep mining must face and solve. In order to adapt to the characteristics of deep resource mining, various techniques involving deep drilling and mining construction also need theoretical and technological innovation.

In the mining of deep mineral resources or other underground engineering, rock roadway (rock tunnel) excavation is the foundation. Among them, the drilling and blasting method realizes rock crushing by mechanical drilling and charge blasting, and is an important construction method for rock roadway excavation. In drilling and blasting excavation, the key to speed is cutting, and the key to quality is the periphery. The pros and cons of the effect of cut blasting play a decisive role in the excavation footage.

The inventor of the present application found in the process of realizing the present application that: at present, the cut blasting technologies such as staged and segmented cut blasting, large-diameter empty hole cut blasting, wedge-straight composite cutting, etc. have also achieved certain results in the application of medium-length hole blasting. However, due to the lack of comprehensive consideration of the influence of deep crustal stress characteristics on blasting cracks, the blasting effect is not good.

SUMMARY OF THE APPLICATION

In view of this, the embodiments of the present application provide an efficient cut blasting method for medium-length holes in deep high-stress rock roadway based on crustal stress induction effect, and based on the induction effect of the crustal stress on the blasting crack propagation and the impact effect of the crustal stress on rock crushing and throwing found in engineering practice, for the cut blasting of medium-length holes in the deep high-stress rock roadway, the impact effect of the crustal stress on rock crushing and throwing is fully and comprehensively considered in the arrangement of the cut blasting hole net, which can improve the cut blasting effect of the medium-length holes in the high-stress rock roadway.

In order to achieve the above-mentioned purpose of the application, the present application adopts the following technical solutions:

an efficient cut blasting method for medium-length holes in deep high-stress rock roadway, comprising the steps of:

carrying out a crustal stress blasting test on a free face of an in-situ rock roadway to be excavated, and obtaining a distribution state of cracks under the synergistic action of crustal stress, explosion stress waves and clamping force of surrounding rock of a rock mass in a stratum where the in-situ rock roadway to be excavated is located; arranging a cutting hole net on the free face of the rock roadway to be excavated according to the distribution state of the cracks; performing cut blasting based on the cutting hole net ;

the step of carrying out a crustal stress blasting test on the free face of the in-situ rock roadway to be excavated, and obtaining the distribution state of cracks under the synergistic action of crustal stress, explosion stress waves and the clamping force of the surrounding rock of the rock mass in the stratum where the in-situ rock roadway to be excavated is located includes: drilling at least one test blast hole with the same depth as that of the cutting hole on the free face of the rock roadway to be excavated, and the diameter of the test blast hole is the same as that of the cutting hole; loading the same amount of explosives with the same charging method as that of the cutting hole in the test blast hole, and inserting a detonator and blocking the blast hole; detonating the detonator with an igniter and detonating the explosive through the detonator; after the explosion of explosives, the rock mass around the test blast hole is broken and cracks are formed, based on the synergistic action of the explosion stress waves, the deep crustal stress and the clamping force of the surrounding rock around the test blast hole; according to the visible cracks on the surface of the free face, determining the distribution state of the cracks on the rock mass section perpendicular to the axial direction of the blast hole; the rock mass section perpendicular to the axial direction of the blast hole contains a surface of the free face; determining the distribution state of the cracks on the rock mass section perpendicular to the axial direction of the blast hole according to the visible cracks on the surface of the free face includes: taking the test blast hole as the center, determining the length of the crack extending around; using spray paint, marker pen or electronic scanner to connect the end points of the crack length to outline or draw the crack distribution profile on the surface of the free face to form the corresponding peripheral envelope of the cracks; arranging a cutting hole net on the free face of the rock roadway to be excavated according to the distribution state of the cracks includes: according to the shape and size of the peripheral envelope of the cracks, arranging the cutting hole net on the free face of the rock roadway to be excavated; the shape of the peripheral envelope of the cracks is an ellipse, and the size of the peripheral envelope of the cracks is represented by its major axis and its minor axis; arranging the cutting hole net on the free face of the rock roadway to be excavated according to the shape and size of the peripheral envelope of the cracks includes: at least arranging a first group of cutting holes, and at least 4 cutting holes should be arranged in the first group, which are respectively the first cutting hole, the second cutting hole, the third cutting hole and the fourth cutting hole; the hole diameter, hole depth, charging method and charging amount of the first cutting hole, the second cutting hole, the third cutting hole and the fourth cutting hole are the same as that of the test blast hole; according as the peripheral envelope of the cracks after the first cutting hole is detonated, and the peripheral envelope of the cracks after the second cutting hole and the third cutting hole are detonated respectively, have at least a tangent or intersecting part respectively, the peripheral envelope of the cracks after the second cutting hole is detonated and the peripheral envelope of the cracks after the third cutting hole is detonated have at least a tangent or intersecting part, and the peripheral envelope of the cracks after the fourth cutting hole is detonated and the peripheral envelope of the cracks after the second cutting hole and the third cutting hole are detonated respectively, have at least a tangent or intersecting part respectively, the first cutting hole, the second cutting hole, the third cutting hole and the fourth cutting hole are arranged to form a first cutting area; the shape of the peripheral envelope of the cracks on the rock mass section upward along the axial direction of the blast hole and perpendicular to the axial direction of the blast hole is consistent; determining the distribution state of the cracks on the rock mass section perpendicular to the axial direction of the blast hole according to the visible cracks on the surface of the free face further includes: determining the size of the peripheral envelope of the cracks on the rock mass section upward along the axial direction of the blast hole and perpendicular to the axial direction of the blast hole; determining the three-dimensional distribution state of single-hole blasting cracks under the combined effect of crustal stress, explosion stress waves and clamping force of surrounding rock, according to the obtained shape and size of the peripheral envelope of the cracks on the rock mass section upward along the axial direction of the blast hole and perpendicular to the axial direction of the blast hole; the second cutting hole and the third cutting hole are respectively drilled obliquely to the center of the first cutting area; the center distance from the hole bottom of the second cutting hole to the hole bottom of the third cutting hole is less than or equal to the minor axis length of the peripheral envelope of the cracks at the hole bottom; the center distance from the hole bottom of the first cutting hole to the hole bottom of the fourth cutting hole is less than or equal to $\sqrt{3}$ times of the major axis length of the peripheral envelope of the cracks at the hole bottom.

Optionally, the first cutting hole and the fourth cutting hole are symmetrically arranged with respect to a center line connecting the second cutting hole and the third cutting hole.

Optionally, the center distance between the first cutting hole and the fourth cutting hole $l_1 \leq \sqrt{3}a$, the center distance between the second cutting hole and the third cutting hole $l_2 \leq b$. The center distance between the first cutting hole and the second cutting hole, the center distance between the first cutting hole and the third cutting hole, the center distance between the second cutting hole and the fourth cutting hole, the center distance between the third cutting hole and the fourth cutting hole all must satisfy $$l_3 \leq \frac{\sqrt{3a^2 + b^2}}{2},$$

wherein a is the major axis length of the peripheral envelope of the cracks on the surface of the free face, and b is the minor axis length of the peripheral envelope of the cracks on the surface of the free face.

Optionally, arranging the cutting hole net on the free face of the rock roadway to be excavated according to the distribution state of cracks further includes: determining the horizontal offset distance of the center of the peripheral envelope of the cracks on the surface of the free face relative to the center of the peripheral envelope of the cracks at the hole bottom according to the three-dimensional distribution state of the single-hole blasting cracks; based on the horizontal offset distance, determining the positions of the orifice and the hole bottom of the second and third cutting holes; based on the determined positions of the orifice and the hole bottom, drilling the second cutting hole and the third cutting hole obliquely from the orifice, so that the center distance from the center of the hole bottom of the second cutting hole and the third cutting hole to the center of the orifice is greater than or equal to the horizontal offset distance.

Optionally, the second cutting hole and the third cutting hole are obliquely drilled at an angle $$\theta_{horizontal} \geq \arctan\left(\frac{b - b_0}{2l}\right),$$

wherein b is the center distance between the orifice of the second cutting hole and the orifice of the third cutting hole, $b_0$ is the center distance between the hole bottom of the second cutting hole and the hole bottom of the third cutting hole, l is the hole depth of the second cutting hole and the third cutting hole.

Optionally, arranging the cutting hole net on the free face of the rock roadway to be excavated according to the distribution state of the cracks further includes: according to the three-dimensional distribution state of the single-hole blasting cracks, determining the horizontal offset distance of the center of the peripheral envelope of cracks on the surface of the free face relative to the center of the peripheral envelope of cracks at the hole bottom; based on the horizontal offset distance, determining the positions of the orifice and the hole bottom of the first cutting hole and the fourth cutting hole; based on the determined positions of the orifice and the hole bottom, drilling the first cutting hole and the fourth cutting hole obliquely from the orifice towards the center of the first cutting area respectively, so that the center distance from the center of the hole bottom of the first cutting hole and the fourth cutting hole to the center of the orifice is greater than or equal to the horizontal offset distance.

Optionally, the first cutting hole and the fourth cutting hole are obliquely drilled at an angle $$\theta_{vertical} \geq \text{arc tan}\left(\frac{\sqrt{3}\,(a - a_0)}{2l}\right),$$

wherein a is the major axis length of the periphery envelope of the elliptical cracks at the orifice, $a_0$ is the major axis length of the periphery envelope of the elliptical cracks at the hole bottom, l is the hole depth of the first cutting hole and the fourth cutting hole.

Optionally, after obtaining the three-dimensional distribution state of the single-hole blasting cracks, the method further includes: according to the length of the major axis and the minor axis of the periphery envelope of the cracks at the hole bottom, the length of the major axis and the minor axis of the periphery envelope of the elliptic cracks at the orifice, and the single-hole charge, determining the unit consumption of explosives for medium-length hole cut blasting in the rock roadway to be excavated.

The efficient cut blasting method for medium-length holes in deep high-stress rock roadway based on crustal stress induction effect provided by the embodiment of the present application, when excavating a deep high-stress rock roadway based on the drilling and blasting method, by carrying out a crustal stress blasting test on the free face of the in-situ rock roadway to be excavated, obtaining in advance the distribution state of the crack under the synergistic action of crustal stress, explosion stress waves and clamping force of surrounding rock of a rock mass in the stratum where the in-situ rock roadway to be excavated is located; arranging a cutting hole net on the free face of the rock roadway to be excavated according to the distribution state of the cracks; performing cut blasting based on the cutting hole net. In this way, since a crustal stress blasting test is carried out on the free face of the in-situ rock roadway to be excavated during the arrangement of the cutting hole net, obtaining in advance the distribution state of the cracks under the synergistic action of crustal stress, explosion stress waves and clamping force of surrounding rock of a rock mass in the stratum where the in-situ rock roadway to be excavated is located, and comprehensively considering the synergistic action of the high crustal stress, the explosion stress waves and the clamping force of the deep-hole rock mass on the blasting cracks in the drilling and blasting engineering of the deep high-stress rock roadway. For the medium-length hole cut blasting of deep high-stress rock roadway, fully and comprehensively considering the impact effect of crustal stress on rock crushing and throwing during the arrangement of cut blasting net, can improve the effect of medium-length hole cut blasting in deep high-stress rock roadway, compared with performing blasting with the arrangement method of the hole net in the current embodiment where the characteristics of high-stress rock roadway is not comprehensively considered.

DESCRIPTION OF DRAWINGS

In order to illustrate the technical solutions of the embodiments of the present application more clearly, the following briefly introduces the accompanying drawings that need to be used in the description of the embodiments or the prior art. Obviously, the drawings in the following description are only some of embodiments of the present application, for those of ordinary skill in the art, other drawings can also be obtained according to these drawings without any creative effort.

DETAILED DESCRIPTION

Figure 1:
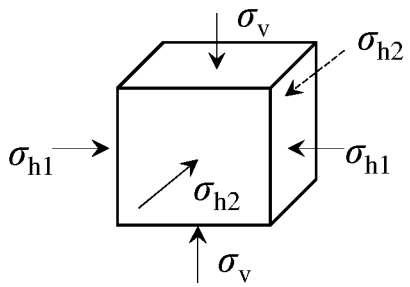
FIG. 1 is a model diagram of the three-dimensional crustal stress state of the deep unexcavated rock mass of the present application.

The embodiments of the present application will be described in detail below with reference to the accompanying drawings.

It should be clear that, in order to illustrate the present application more clearly, numerous technical details are described in the following specific embodiments, and those skilled in the art should understand that the present application can also be implemented without some of the details. In addition, in order to highlight the gist of the present application, some related methods, means, components and their applications that are well known to those skilled in the art are not described in detail, but this does not affect the implementation of the present application. The embodiments described herein are only some, but not all, embodiments of the present application. Based on the embodiments of the present application, all other embodiments obtained by those of ordinary skill in the art without creative efforts shall fall within the protection scope of the present application.

The efficient cut blasting method for medium-length holes in deep high-stress rock roadway based on crustal stress induction effect provided by the embodiments of the present application is suitable for blasting excavation engineering in deep high-stress rock roadways. As resource mining shifts from shallow to deep, the mining depth of coal has reached 1500 meters, the mining depth of geothermal and non-ferrous metals has exceeded 3000 meters and 4350 meters respectively, and the mining depth of oil and gas resources has reached 7500 meters. Among them, 'deep' or 'deep rock mass' has no clear and specific definition in the industry, which is relative to 'shallow' or 'shallow rock mass'. One of the main features of deep rock mass is high crustal stress. Some countries take a few hundred meters as boundary, and some take more than a thousand meters as boundary. It is nothing more than different crustal stress values, but they all have the characteristics of high crustal stress of deep rock mass. The medium-length hole refers to a blast hole with a depth of more than 2.5 m. The blasting effect of medium-length hole cut blasting in deep high-stress rock mass is mainly affected by two factors. One is the guiding effect of crustal stress on the expansion of blast cracks, and the other is the impact effect of deep hole clamping effect on rock crushing and throwing. At present, the industry has not comprehensively considered the high stress characteristics of deep rock mass when implementing deep rock mass cut blasting, resulting in unsatisfactory blasting effect.

In the embodiment of the present application, the induction effect of crustal stress on the expansion of blasting cracks and the effect of deep hole clamping effect on rock crushing and throwing are comprehensively considered in the arrangement of the cutting hole net, which is conducive to making full use of the induction effect of crustal stress on the expansion of blasting cracks and weakening the clamping effect of the deep hole surrounding rock, thereby improving the blasting effect.

Before proposing the present application, the inventor of the present application has done a lot of related research based on the practice of deep rock roadway engineering. It mainly includes: the impact effect of crustal stress on the propagation of blast cracks. This research result is helpful for in-depth understanding of the technical solutions provided by the embodiments of the present application and their technical effects. For this reason, the following is a description of this study: the impact effect of crustal stress on the propagation of blast cracks.

Figure 2:
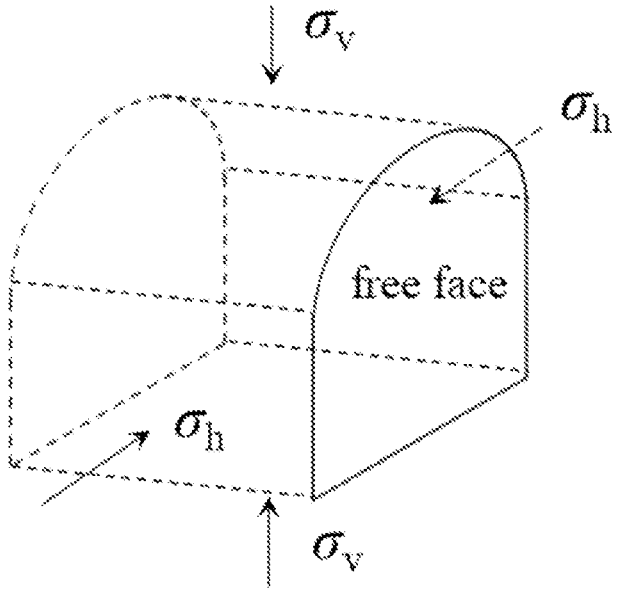
FIG. 2 is a model diagram of the actual crustal stress state of the rock roadway excavated along the horizontal direction in the deep rock mass of the present application.

According to engineering practice research, the deep unexcavated rock mass is generally in a three-dimensional stress state, with horizontal crustal stresses $\sigma_{h1}$ and $\sigma_{h2}$ and vertical crustal stress $\sigma_v$, as shown in FIG. 1. However, for the rock roadway excavated in the horizontal direction in the deep rock mass, because of the existence of the free face (also called free surface, is the surface where the blasted rock or medium is in contact with the air, the blasted rock slides along this surface, emphasizing the sliding surface of the rock mass during blasting), the horizontal crustal stress perpendicular to the free face has been released when the free face is formed, that is, the horizontal crustal stress perpendicular to the free face is 0. It can be seen that the actual crustal stress state of the deep rock roadway can be simplified as a two-dimensional plane strain state, that is, it is subjected to the action of the horizontal crustal stress $\sigma_h$ and the vertical crustal stress $\sigma_v$ parallel to the free face, as shown in FIG. 2.

Crustal stress has a significant effect on the propagation of blast cracks. The continuous-discontinuous element method (CDEM) can be used to carry out a numerical simulation study of two-dimensional plane strain on the propagation behavior of blasting cracks under different crustal stress conditions. The following is a detailed analysis of the impact effect of crustal stress on the propagation of blast cracks based on numerical simulation results. The Protodyakonov coefficient of the rock in the numerical simulation is 3, that is, the compressive strength is 30 MPa.

Figure 3:
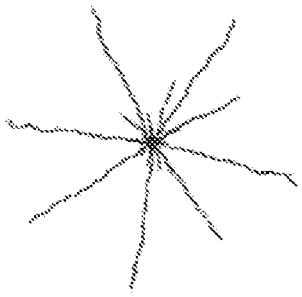
FIG. 3 is a diagram of the distribution state of cracks without the action of crustal stress.

FIG. 3 is a diagram of the distribution state of cracks without the action of crustal stress. Referring to FIG. 3, the vertical crustal stress $\sigma_v=0$, and the horizontal crustal stress $\sigma_h=0$, which is used as a control group to compare with the distribution state of blast cracks in different crustal stress fields.

Figure 4:
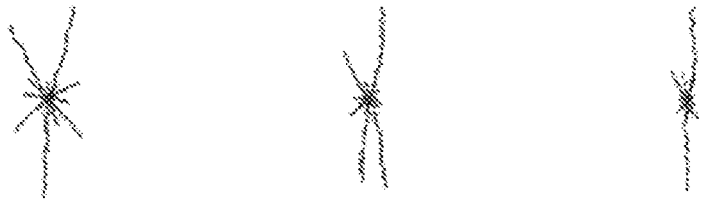
FIG. 4 is a diagram of the distribution state of blast cracks under the action of different unidirectional crustal stresses.

FIG. 4 shows the diagram of the distribution state of blast cracks under the action of different unidirectional crustal stresses. Among them, the vertical crustal stress $\sigma_v>0$, and the horizontal crustal stress $\sigma_h=0$. The crustal stress $\sigma_v$ in the vertical direction increases sequentially from left to right in the diagram of the distribution state of blast cracks in FIG. 4. Compared with FIG. 3, it can be seen from FIG. 4 that with the increase of the crustal stress $\sigma_v$ in the vertical direction, the crack propagation length in the horizontal direction gradually decreases.

Figure 5:
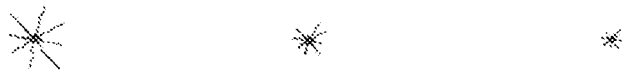
FIG. 5 is a diagram of the distribution state of blast cracks under the action of bidirectional isobaric crustal stress.

FIG. 5 shows the diagram of the distribution state of blast cracks under the action of bidirectional isobaric crustal stress. Among them, the vertical crustal stress $\sigma_v$ is equal to the horizontal crustal stress $\sigma_h$. It can be seen from the figure that with the increase of bidirectional isobaric crustal stress, the crack propagation length in both vertical and horizontal directions gradually decreases, and the crack distribution range gradually decreases.

Figure 6:
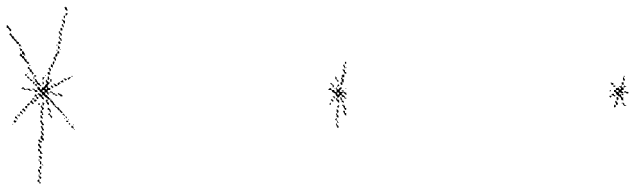
FIG. 6 is a diagram of the distribution state of blast cracks under the action of bidirectional anisobaric crustal stress.

FIG. 6 shows a diagram of the distribution state of blast cracks under the action of bidirectional anisobaric crustal stress. Among them the vertical crustal stress $\sigma_v$ is not equal to the horizontal crustal stress $\sigma_h$, and $\sigma_v-\sigma_h=5$ MPa. It can be seen from the figure that under the condition of the same principal stress difference ($\sigma_v-\sigma_h=5$ MPa), the difference in the relative value of crustal stress also has a significant effect on the expansion of blast cracks. The horizontal crack propagation length decreases with the increase of the horizontal crustal stress $\sigma_h$, and the vertical crack propagation length also decreases with the increase of the vertical crustal stress $\sigma_v$.

According to the above control experiments and analysis, it can be clear that the effect of crustal stress has a significant impact on the distribution state of blast cracks, and different crustal stress states have different influence laws on the distribution state of blast cracks. Therefore, for the blasting of medium-length holes in deep high-stress rock roadways, the impact effect of crustal stress on the blasting effect must be considered to further improve the blasting effect. Generally, in engineering practice, the excavated rock mass of a deep high-stress rock roadway is often in a state of bidirectional unequal pressure crustal stress, as the working condition shown in FIG. 6.

Figure 7:
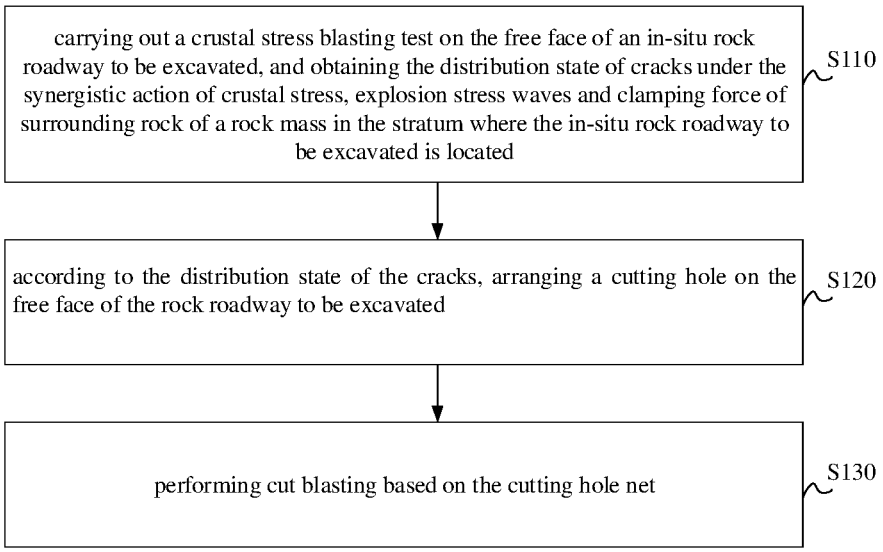
FIG. 7 is a schematic flowchart of an efficient cut blasting method for medium-length holes in deep high-stress rock roadways based on crustal stress induction effect according to an embodiment of the present application.

Referring to FIG. 7, in some embodiments, the efficient cut blasting method for medium-length holes in deep high-stress rock roadways based on crustal stress induction effect includes the steps:

S110. carrying out a crustal stress blasting test on the free face of an in-situ rock roadway to be excavated, and obtaining the distribution state of cracks under the synergistic action of crustal stress, explosion stress waves and clamping force of surrounding rock of a rock mass in the stratum where the in-situ rock roadway to be excavated is located;

The crustal stress state of deep rock mass is complex and is often affected by tectonic stress. Conventional measurement methods of crustal stress have complex procedures and poor real-time performance, and it is difficult to directly establish the correlation of crustal stress on blasting crack propagation and blasting effect, and cannot directly guide blasting parameter optimization and drilling and blasting construction.

Therefore, in order to determine the distribution state of blast cracks under the synergistic action of crustal stress, explosion stress waves and clamping force of surrounding rock of the rock mass in the stratum where the in-situ rock roadway (high-stress rock roadway) to be excavated is located, based on the above impact effect of the crustal stress state on the distribution law of the blast crack, in some embodiments, the in-situ single-hole blasting method for crustal stress testing can be used.

Specifically, carrying out the crustal stress blasting test on the free face of the in-situ rock roadway to be excavated, and obtaining the distribution state of blast cracks under the synergistic action of crustal stress, explosion stress waves and the clamping force of the surrounding rock of the rock mass in the stratum where the in-situ rock roadway to be excavated is located (step S110) includes: drilling at least one test blast hole with the same depth as that of the cutting hole on the free face of the rock roadway to be excavated, and the diameter of the test blast hole is the same as that of the cutting hole; loading the same amount of explosives with the same charging method as that of the cutting hole in the test blast hole, inserting a detonator and blocking the blast hole.

In this embodiment, before the rock roadway excavation and blasting is officially carried out, at least one test blast hole with the same depth as that of the cutting hole is drilled on the free face of the rock roadway to be excavated, which is used to characterize and reflect the real state of crack distribution under the synergistic action of crustal stress, explosion stress waves and clamping force of surrounding rock after detonation of the stratum where the rock roadway to be excavated is located, and is used in reverse as the basis for the arrangement of the cutting hole net to adapt to the characteristics of high-stress rock roadway, which is conducive to improving cut blasting effect of medium-length hole in high-stress rock roadway.

Figure 8:
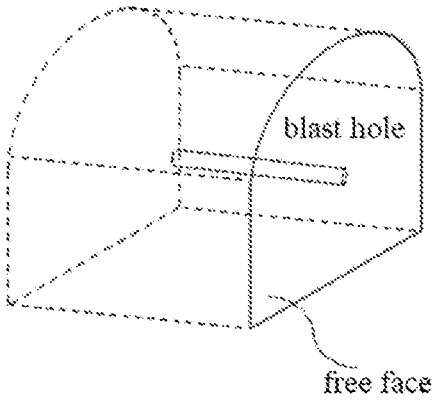
FIG. 8 is a schematic diagram of the relative position of the test blast hole on the free face of the rock roadway to be excavated.

As an optional embodiment of the present application, a cutting hole with the same depth as that of the test blast hole is drilled in the middle of the free face of the high-stress rock roadway. The relative positions of the test blast holes are shown in FIG. 8.

Detonate the detonator with an igniter and detonate the explosive through the detonator; after the explosion of explosives, the rock mass around the test blast hole is broken and cracks are formed, based on the synergistic action of the explosion stress waves, the deep crustal stress and the clamping force of the surrounding rock around the test blast hole.

In this embodiment, after the preparations for detonation of the test blast hole are ready, the relevant personnel are transferred to a safe place and set up a cordon, and the detonator is detonated with an igniter, and the explosive is detonated by the detonator. After the explosive is detonated, the rock mass around the blast hole will be broken and cracked under the synergistic action of the explosion stress wave, the deep crustal stress and the clamping force of the surrounding rock around the test blast hole.

It can be understood that, different from the blasting of the shallow-hole rock roadway in the shallow rock mass, in the deep high-stress rock roadway in this embodiment, the rock crushing in the cutting area is made under the combined effect of crustal stress, explosion stress and clamping force of hole bottom. After blasting, cracks will appear on the rock mass section perpendicular to the axial direction of the blast hole, and cracks will also appear on the surface of the free face of the rock roadway (the surface where the orifice is located).

According to the visible cracks on the surface of the free face, the distribution state of the cracks on the rock mass section perpendicular to the axial direction of the blast hole is determined.

According to engineering practice research, the shape of the peripheral envelope of the cracks is mainly affected by the crustal stress state. Therefore, due to the stress state environment in the same stratum located, the shape of the crack distribution on the rock section perpendicular to the axial direction of the blast hole is basically consistent. In this way, according to the distribution of visible cracks on the surface of the free face, the distribution state of the cracks on the rock mass section perpendicular to the axial direction of the blast hole can be determined. The crack distribution state contains: the shape of peripheral envelope (contour) of the cracks.

Specifically, the rock mass section perpendicular to the axial direction of the blast hole contains a surface of the free face; determining the distribution state of the cracks on the rock mass section perpendicular to the axial direction of the blast hole according to the visible cracks on the surface of the free face includes:

taking the test blast hole as the center, determine the length of the crack extending around; using spray paint, marker pen or electronic scanner to connect the end points of the crack length to outline or draw the crack distribution profile on the surface of the free face to form the corresponding peripheral envelope of the cracks;

In this embodiment, the crack distribution profile (i.e., the peripheral envelope, as shown in FIG. 8) on the surface of the free face can be initially outlined with spray paint, a marker pen, an electronic scanner, or the like. The crack length and the shape and size of the peripheral envelope of the cracks are affected by the crustal stress state. As mentioned above, in general, the magnitudes of the crustal stress $\sigma_h$ in the horizontal direction and the crustal stress $\sigma_v$ in the vertical direction are different.

Figure 9:
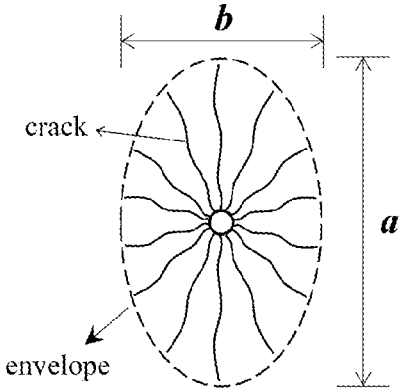
FIG. 9 is a schematic diagram of the distribution of cracks on the free face or perpendicular to the axial section of the blast hole.

FIG. 9 shows a schematic diagram of the distribution of cracks on the free face or perpendicular to the axial section of the blast hole. In this embodiment, the crustal stress $\sigma_v$ in the vertical direction is greater than the crustal stress $\sigma_h$ in the horizontal direction, and the peripheral envelope of the cracks is elliptical. The direction of the major axis a of the elliptical envelope is vertical, and the direction of the minor axis b is horizontal.

It can be seen that the direction of maximum principal stress of the crustal stress field can also be intuitively judged according to the crack distribution shape of the surface of the free face. The situation shown in FIG. 9 is that the crustal stress in the vertical direction is the maximum principal stress. Other crustal stress distributions can also be judged based on this analogy.

As mentioned above, the shape of the peripheral envelope of the cracks is mainly affected by the state of crustal stress, but the size and range of the crack peripheral envelope are not only affected by the state of crustal stress, but also by the clamping effect of the rock mass. Since the clamping force of rock mass received by the blast hole gradually increases from the orifice to the hole bottom, the size and range of the peripheral envelope of the cracks will be different.

In order to determine the three-dimensional distribution state of the blast cracks formed in the axial direction of the blast hole, in some embodiments, the shape of the peripheral envelope of the cracks on the rock mass section upward along the axial direction of the blast hole and perpendicular to the axial direction of the blast hole is consistent; determining the distribution state of the cracks on the rock mass section perpendicular to the axial direction of the blast hole according to the visible cracks on the surface of the free face further includes: determining the size of the peripheral envelope of the cracks on the rock mass section upward along the axial direction of the blast hole and perpendicular to the axial direction of the blast hole; determining the three-dimensional distribution state of single-hole blasting cracks under the combined action of crustal stress, explosion stress waves and clamping effect of surrounding rock, according to the obtained shape and size of the peripheral envelope of the cracks on the rock mass section upward along the axial direction of the blast hole and perpendicular to the axial direction of the blast hole.

Figure 10:
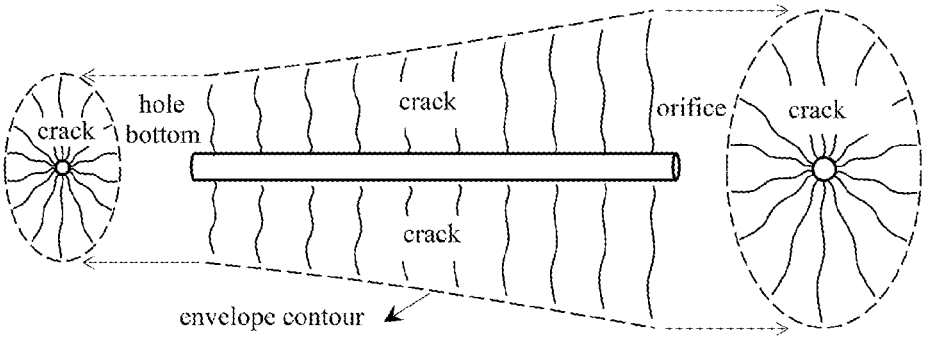
FIG. 10 is a schematic diagram of the crack distribution along the axial section of the blast hole.

Referring to FIG. 10, for medium-length hole blasting, from the orifice (free face) to the hole bottom, the clamping effect of the surrounding rock gradually increases. The rock clamping effect at the orifice is small, while the rock clamping effect at the hole bottom is large. After the explosion of the test blast hole, the shape of the peripheral envelope of the cracks at the hole bottom is the same as that at the orifice, and its major and minor axis are in the same direction, but its size and range are smaller than those at the orifice. Therefore, the distribution range of cracks at the orifice cannot represent the distribution range of cracks at different sections along the axial direction of the blast hole. It is necessary to further obtain the distribution range of cracks at different sections along the axial direction of the blast hole. After the shape and size of the peripheral envelope of the cracks on the rock mass section perpendicular to the axial direction of the blast hole is determined, the three-dimensional distribution state of the single-hole blasting cracks can be drawn, as shown in FIG. 10.

Figure 11:
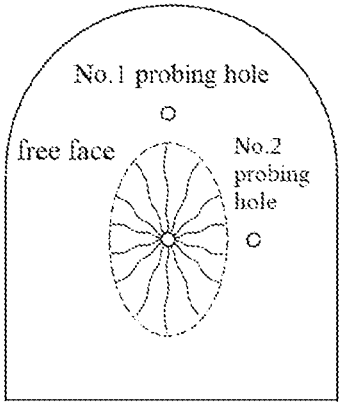
FIG. 11 is a schematic diagram of the relative position of the arrangement of probing holes on the free face.

Exemplarily, the crack distribution range at different sections along the axial direction of the blast hole can be obtained by using the method of borehole acoustic wave testing. Since the shape of the peripheral envelope of the cracks at other sections is the same as that at the free face, it is only necessary to determine the characteristic size of the envelope at other sections to determine the range and size of the envelope. For the elliptical envelope, it is only necessary to determine the length of the semi-major axis a/2 and the length of the semi-minor axis b/2. As shown in FIG. 11, drill two probing holes with the same depth as that of the blast hole on the free face. The No. 1 probing hole is located in the major axis direction of the ellipse envelope, and the No. 2 probing hole is located in the minor axis direction of the ellipse envelope. Water is injected into the blast hole and two probing holes, the blast hole is used as an acoustic wave emission hole, and the two probing holes are used as acoustic wave receiving holes. The acoustic signals at different hole depths before and after blasting are tested and analyzed, and the damage degrees at different hole depths and the equivalent length of blast cracks are obtained. That is, the lengths of the semi-major and semi-minor axes of the ellipse envelope at different sections are obtained. The measurement technical solution provided in this embodiment can determine crack distribution envelope at different sections along the axial direction of the blast hole with as few probing holes as possible.

Figure 12:
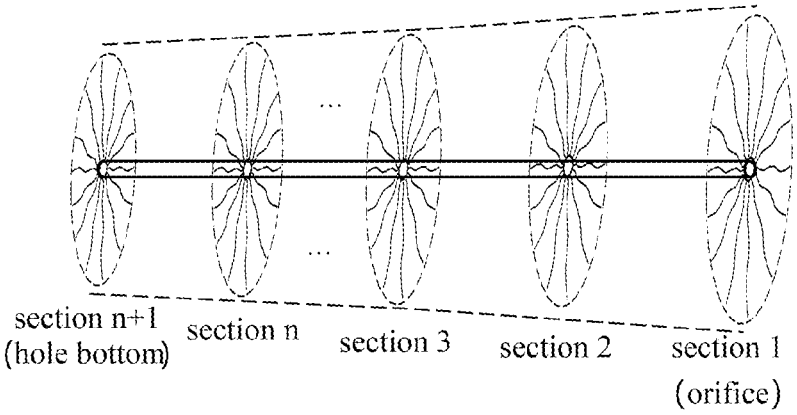
FIG. 12 is a schematic diagram of the three-dimensional crack distribution along the axial direction of the blast hole under the condition of single-hole blasting.

According to the above steps, the three-dimensional crack distribution along the axial direction of the blast hole under the condition of single-hole blasting can be obtained, as shown in FIG. 12. In this way, the range and size of the peripheral envelope of the single-hole burst crack under the combined action of crustal stress, explosion stress and clamping effect can be obtained, and then the corresponding three-dimensional distribution state of the single-hole burst crack can be determined.

Figure 13:
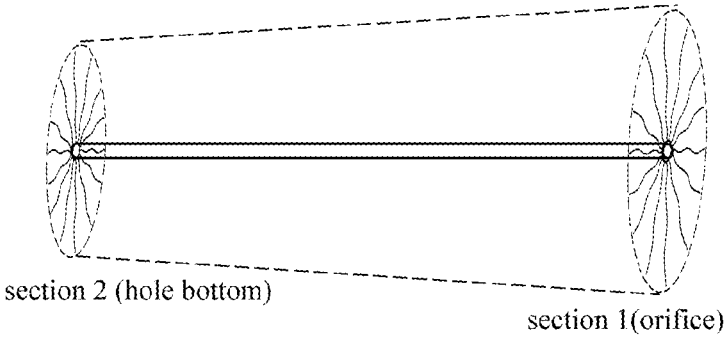
FIG. 13 is a simplified diagram of the three-dimensional crack distribution range (peripheral envelope) under the condition of single-hole blasting.

It can be understood that, as shown in FIG. 12, in the above-mentioned technical scheme of obtaining the size of the peripheral envelope of the cracks at different sections along the axial direction of the blast hole by the method of acoustic wave testing, the more sections are selected, the more accurate the distribution range of the three-dimensional cracks finally obtained. However, the workload and the amount of calculation for field testing have increased considerably. Considering the simplicity and practicability of engineering application, the section of the hole bottom can be tested only, to obtain the peripheral envelope of the crack at the position of the hole bottom. The entire blasting rupture range can be approximately regarded as a platform with elliptical upper and lower bottom surfaces, as shown in FIG. 13.

It should be noted that there are many methods for obtaining the distribution range and size of cracks at different sections, and the method of acoustic wave testing is only used as an example here. In order to highlight the innovative spirit of the present application, other methods will not be enumerated.

Further, after obtaining the three-dimensional distribution state of the single-hole burst cracks, the method further includes: according to the length of the major axis and the minor axis of the peripheral envelope of the cracks at the hole bottom, and the length of the peripheral envelope of the cracks at the surface of the free face, the length of the major axis and the minor axis of the elliptical envelope at the orifice and the single-hole charge, the unit consumption of explosives for medium-length cut blasting in the rock roadway to be excavated is determined.

Exemplarily, the major axis length of the peripheral envelope of the elliptical crack at the orifice is a, and the minor axis length is b; the major axis length of the peripheral envelope of the elliptical crack at the hole bottom is $a_0$, and the minor axis length is $b_0$; the depth of the blast hole is l. Then the volume of the broken rock mass under the condition of single-hole blasting is $$V = \frac{\pi l(ab + a_0 b_0)}{2}.$$

Assuming that the single-hole charge is Q, according to the results of single-hole charge blasting, the unit consumption of explosives $$q = \frac{2Q}{\pi l(ab + a_0 b_0)}$$

for medium-length cut blasting in the high-stress rock roadway can be calculated.

In this embodiment, the influence of the crustal stress state on the unit consumption of the explosive can also be determined, specifically: drilling a stress-free test blast hole for comparison in the stress-free stratum; loading with the same amount of explosives with the same charging method in the stress-free test blast hole as that of the test blast hole described in the embodiment, blocking the stress-free test blast hole; detonating the stress-free test blast hole, calculating the corresponding unit consumption of explosive according to the volume of the broken rock mass and the charge amount after the detonation; comparing the unit consumption of explosive with the unit consumption of explosive for medium-length hole cut blasting in the high-stress rock roadway, and determining the degree of influence of crustal stress on the unit consumption of explosive.

S120. According to the distribution state of the cracks, a cutting hole net is arranged on the free face of the rock roadway to be excavated.

After obtaining the three-dimensional distribution characteristics of single-hole blasting cracks in the deep high-stress rock roadway and the size range of the peripheral envelope of the rock crack (ie, the rock mass crushing range), provides a data basis for the development of efficient cut blast hole net arrangement in medium-length holes. For multi-hole cut blasting, the blasting effect can be simplified as the superposition of multiple single-hole blasting effects and crushing ranges.

Figure 14:
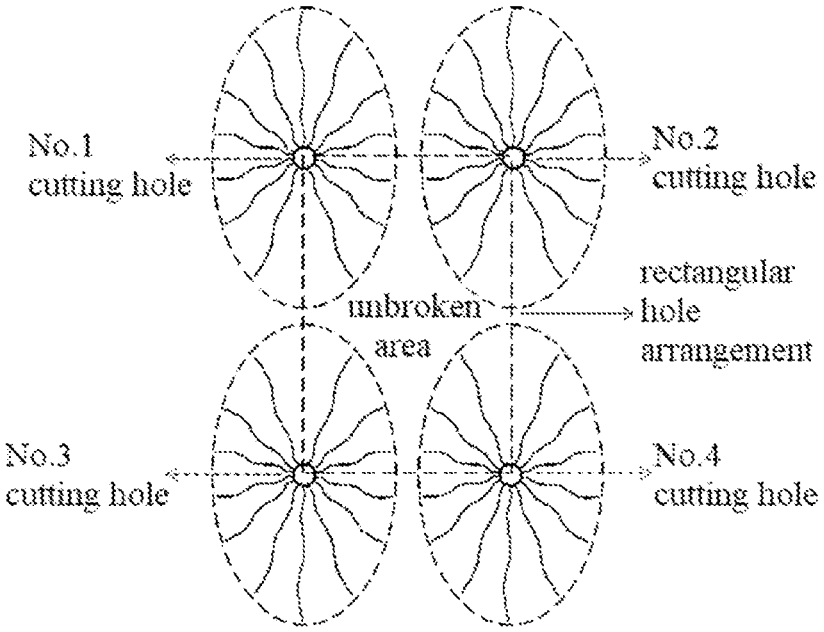
FIG. 14 is a schematic diagram of the peripheral envelope of the blasting cracks corresponding to the rectangular hole arrangement method of medium-length hole cut blasting in deep high-stress rock roadway.

The number of cutting holes commonly used for straight-hole or oblique-hole cutting is 4 or 6. Taking the number of cutting holes as 4 as an example, the first cutting hole is the No. 1 cutting hole, the second cutting hole is the No. 2 cutting hole, the third cutting hole is the No. 3 cutting hole, the fourth cutting hole is the No. 4 cutting hole. Usually, 4 cutting holes are distributed in a rectangular shape. As shown in FIG. 14, in the medium-length hole blasting in the deep high-stress rock roadway, the rectangular arrangement of the cutting holes is unreasonable. It can be found from the figure that under the action of high crustal stress, the peripheral envelopes of the cracks distributed at any vertical section of the blast hole formed by a single blast hole are all elliptical. Therefore, when the cutting holes are in the form of conventional rectangular arrangement of holes, the central part of the cutting area formed by the four cutting holes cannot be covered by the crushing range of each blast hole, that is, the rock mass in this area cannot be effectively broken, resulting in poor cutting effect.

Therefore, it is obviously unreasonable to use the conventional rectangular hole arrangement method for medium-length hole cut blasting in deep high-stress rock roadways. Referring to FIG. 14, in this embodiment, specifically, the step of arranging cutting hole net on the free face of the rock roadway to be excavated according to the distribution state of the cracks (step S120) includes: arranging the cutting hole net on the free face of the rock roadway to be excavated according to the shape and size of the peripheral envelope of the cracks.

For the case where the shape of the peripheral envelope of the cracks is an ellipse, the size of the peripheral envelope of the cracks is represented by its major axis and its minor axis; in some embodiment, the arrangement of the cutting hole net on the free face of the rock roadway to be excavated according to the shape and size of the peripheral envelope of the cracks includes:

At least the first group of cutting holes is arranged, and at least 4 cutting holes should be arranged in the first group, which are respectively the first cutting hole, the second cutting hole, the third cutting hole and the fourth cutting hole. The hole diameter, hole depth, charging method and charging amount of the first cutting hole, the second cutting hole, the third cutting hole and the fourth cutting hole are the same as that of the test blast hole;

according as the peripheral envelope of the cracks after the first cutting hole is detonated, and the peripheral envelope of the cracks after the second cutting hole and the third cutting hole are detonated respectively, have at least a tangent or intersecting part respectively, the peripheral envelope of the cracks after the second cutting hole is detonated and the peripheral envelope of the cracks after the third cutting hole is detonated have at least a tangent or intersecting part, and the peripheral envelope of the cracks after the fourth cutting hole is detonated, and the peripheral envelope of the cracks after the second cutting hole and the third cutting hole are detonated respectively, have at least a tangent or intersecting part respectively, and the first cutting hole, the second cutting hole, the third cutting hole and the fourth cutting hole are arranged to form the first cutting area.

Furthermore, the first cutting hole and the fourth cutting hole are symmetrically arranged with respect to the center line connecting the second cutting hole and the third cutting hole.

Still in the form of 4 cutting holes, the parameters of the hole net are optimized according to the scheme provided in this embodiment. One of the schemes provided in this embodiment, exemplarily, the diamond-shaped hole arrangement method shown in FIG. 15. It can be intuitively concluded from the figure that the arrangement of the hole net in this way can reduce the area that cannot be covered by the peripheral envelope of the cracks in the cutting area, thereby increasing the crushing range of rock mass and improving the cut blasting effect of medium-length hole in high-stress rock roadway.

In some embodiments, the center distance between the first cutting hole and the fourth cutting hole $l_1 \leq \sqrt{3}a$, the center distance between the second cutting hole and the third cutting hole $l_2 \leq b$, the center distance between the first cutting hole and the second cutting hole, the center distance between the first cutting hole and the third cutting hole, the center distance between the second cutting hole and the fourth cutting hole, the center distance between the third cutting hole and the fourth cutting hole all must satisfy $$l_3 \leq \frac{\sqrt{3a^2 + b^2}}{2},$$

wherein a is the major axis length of the peripheral envelope of the cracks on the surface of the free face, and b is the minor axis of the peripheral envelope of the cracks on the surface of the free face.

Figure 15:
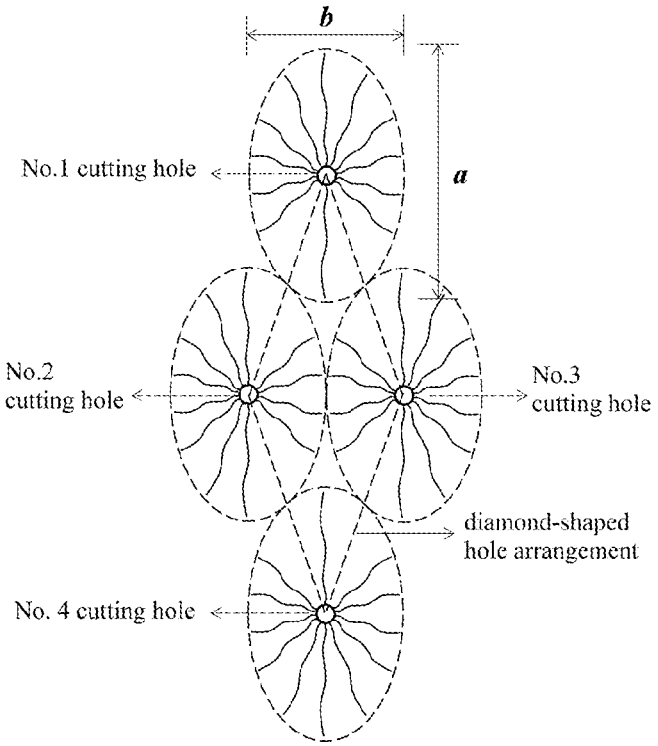
FIG. 15 is a schematic diagram of the peripheral envelope of the blasting crack corresponding to the diamond-shaped hole arrangement method of medium-length hole cut blasting in deep high-stress rock roadway.

Combining with FIG. 15, it can be seen that when the peripheral envelopes of the elliptical cracks formed by the blasting of the four cutting holes are circumscribed to each other, it is the critical condition for the selection of the distance between the blast holes. At this time, the distance between the No. 1 cutting hole and the No. 4 cutting hole is $\sqrt{3}a$, the distance between the No. 2 cutting hole and the No. 3 cutting hole is b. In the case where and the cutting holes are arranged with the elliptical envelopes circumscribed to each other, there is still a small area in the first cutting area that is not covered by the blasting and broken range (peripheral envelopes of the cracks) of each blast hole. Therefore, it is preferable to arrange cutting holes at the intersection of the aforementioned crack peripheral envelopes, so that the first cutting area is completely covered as much as possible. In order to achieve the technical purpose that the first cutting area is completely covered, in some embodiments, according to engineering practice, the blast hole spacing must satisfy: the center distance between the No. 1 cutting hole and the No. 4 cutting hole $l_1 \leq \sqrt{3}a$, the center distance between the No. 2 cutting hole and the No. 3 cutting hole $l_2 \leq b$, Furthermore, according to the geometric relationship, it can be further deduced that the center distance between the No. 1 cutting hole and the No. 2 cutting hole, the center distance between the No. 1 cutting hole and the No. 3 cutting hole, the center distance between the No. 2 cutting hole and the No. 4 cutting hole, the center distance between the No. 3 cutting hole and the No. 4 cutting hole all must satisfy $$l_3 \leq \frac{\sqrt{3a^2 + b^2}}{2},$$

that is, the side length of the rhombus in the example shown in the figure satisfied $$l_3 \leq \frac{\sqrt{3a^2 + b^2}}{2}.$$

In this way, after each cutting hole is blasted, the crushing crack can completely cover the first cutting area, which improves the blasting effect.

Figure 16:
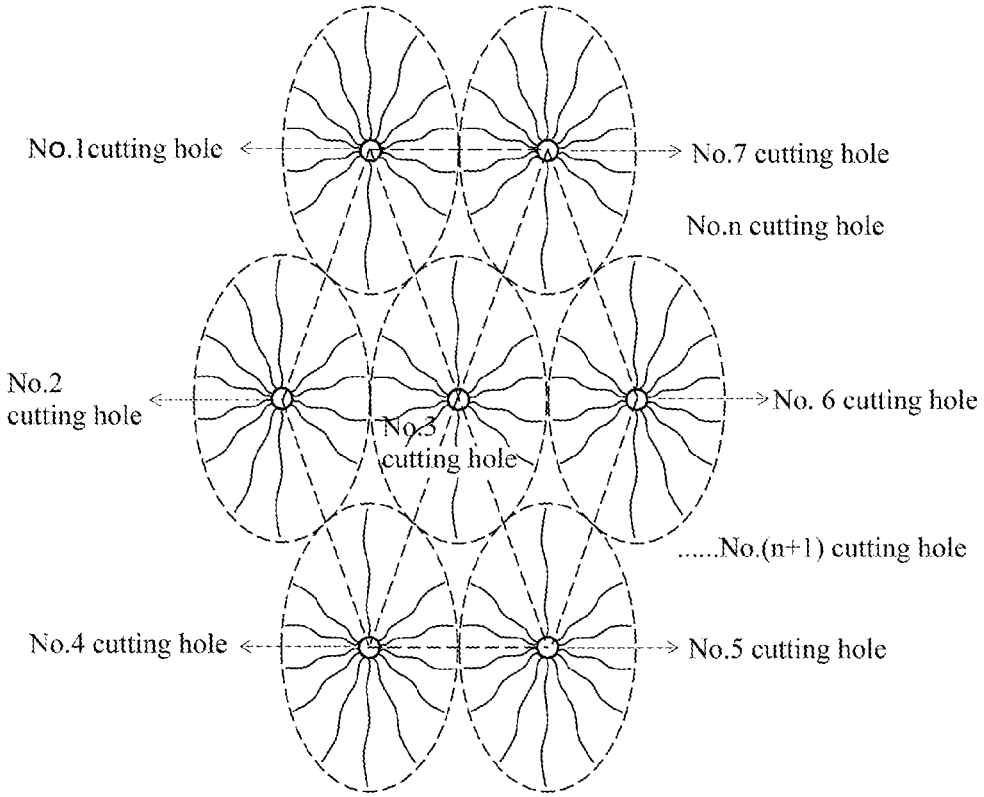
FIG. 16 is a schematic diagram of the peripheral envelope of the blasting cracks corresponding to the modular diamond-shaped hole arrangement method of medium-length hole cut blasting in deep high-stress rock roadway.

It should be noted that the number of cutting holes often needs to be determined according to the actual situation of the project, and the above example is described by taking 4 cutting holes as an example. When the number of cuttings increases, a modular blast hole arrangement method can still be carried out based on the diamond-shaped hole arrangement with four cutting holes, as shown in FIG. 16. The center distance of the relevant blast holes is still set with reference to the case where there are 4 cutting holes. In this way, while making full use of the effective crushing range of the blast hole through the modular hole arrangement method, there is no need to repeat the design, and the design of the hole net parameters is greatly simplified.

According to the foregoing disclosure, for medium-length hole cut blasting, the clamping effect is large, resulting in the effective crushing range at the hole bottom being smaller than that of the orifice. Considering that the clamping force of rock mass also has an influence on the blasting effect of the blast hole. Therefore, in some embodiments, arranging the cutting hole net on the free face of the rock roadway to be excavated according to the crack distribution state further includes: according to the three-dimensional distribution state of the single-hole blasting cracks, determining the horizontal offset distance of the center of the peripheral envelope of cracks on the surface of the free face relative to the center of the peripheral envelope at the hole bottom; based on the horizontal offset distance, determining the positions of the orifice and the hole bottom of the second and third cutting holes; based on the determined positions of the orifice and the hole bottom, drilling the second cutting hole and the third cutting hole obliquely from the orifice, so that the center distance from the center of the hole bottom of the second cutting hole and the third cutting hole to the center of the orifice is greater than or equal to the horizontal offset distance.

In this embodiment, according to the three-dimensional distribution state of single-hole blasting cracks, the influence of the clamping force of rock mass on the peripheral envelopes of the cracks of all sections in the axial direction of the blast hole can be determined, and then based on the influence the arrangement of the cutting hole net can be reversely guided according to the above arrangement method. The further optimization of the cutting hole net can further improve the blasting effect of medium-length hole in the high stress rock roadway.

Figure 17:
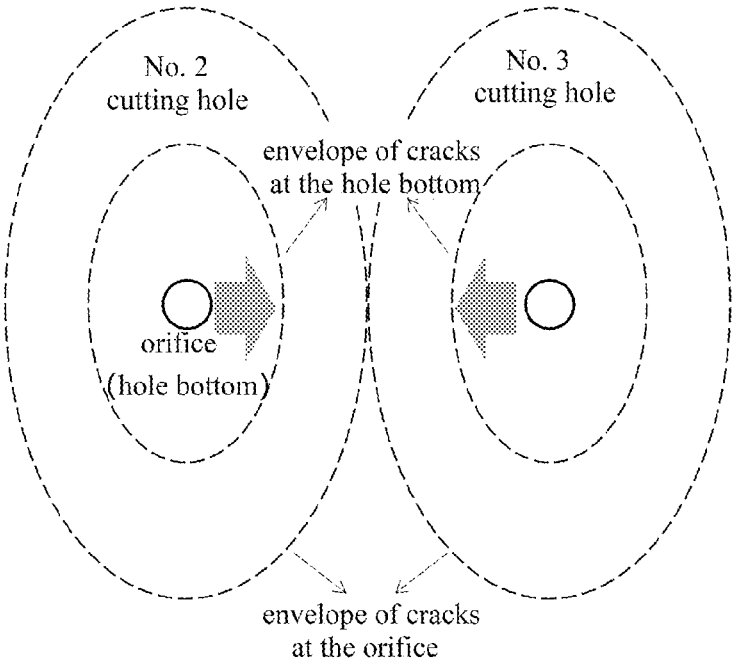
FIG. 17 shows the position of the peripheral envelope at the hole bottom corresponding to the straight hole arrangement method of the No. 2 cutting hole and the No. 3 cutting hole.
Figure 18:
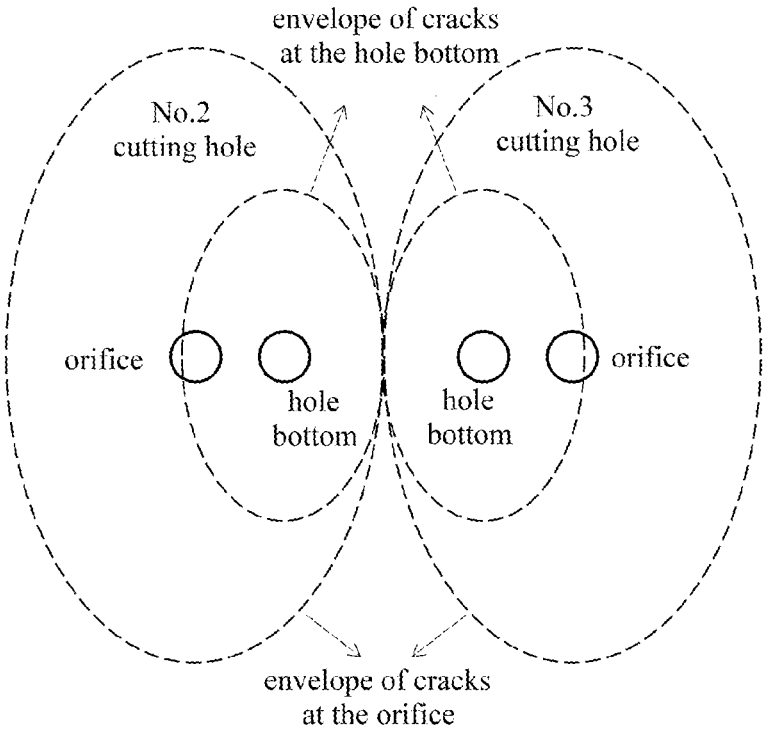
FIG. 18 shows the position of the peripheral envelope at the hole bottom corresponding to the oblique hole arrangement method of the No. 2 cutting hole and the No. 3 cutting hole.

Further, the second cutting hole and the third cutting hole are respectively drilled obliquely to the center of the first cutting area. The center distance from the hole bottom of the second cutting hole to the hole bottom of the third cutting hole is less than or equal to the minor axis length of the peripheral envelope of crack at the hole bottom;

In this embodiment, the hole arrangement method may adopt the diamond hole arrangement or the modular diamond hole arrangement method in the above-mentioned example, but cannot adopt the form of straight-hole cutting. This is because the effective crushing range of the hole bottom of a single blast hole is obviously smaller than that of the orifice, and the straight-hole cutting form causes the hole bottom distance of the blast hole to be too large, and the rock at the bottom of the cutting is difficult to be effectively broken and thrown. Still taking the diamond-shaped hole arrangement of 4 cuttings as an example, the comparison between the straight-hole form and the oblique hole form of the No. 2 cutting and the No. 3 cutting is firstly analyzed. FIG. 17 is in the form of a straight hole. It can be seen that the bottom envelopes of the No. 2 and No. 3 cutting holes do not intersect or are tangent, and there is a wide range of gaps between the two hole bottom envelope, indicating that there is a large range of rock mass at the hole bottom that is not covered by the effective crushing range, which will inevitably lead to poor crushing effect at the hole bottom, and the rock at the hole bottom is difficult to be effectively thrown. Therefore, it is necessary to turn the straight hole into an oblique hole, that is, the No. 2 cutting hole and the No. 3 cutting hole are inclined to the center of the cutting area in the horizontal direction, so that the center distance from the center of the hole bottom of the second cutting hole and the third cutting hole to the center of the orifice is greater than or equal to the horizontal offset distance, that is, the peripheral envelopes of the cracks at the hole bottom of the No. 2 cutting hole and No. 3 cutting hole are close to each other, and the critical condition is that the bottom envelope of the two blasting holes are tangent, as shown in FIG. 18.

Specifically, the second cutting hole and the third cutting hole are drilled obliquely at an angle $$\theta_{horizontal} \geq \arctan\left(\frac{b - b_0}{2l}\right).$$

Figure 19:
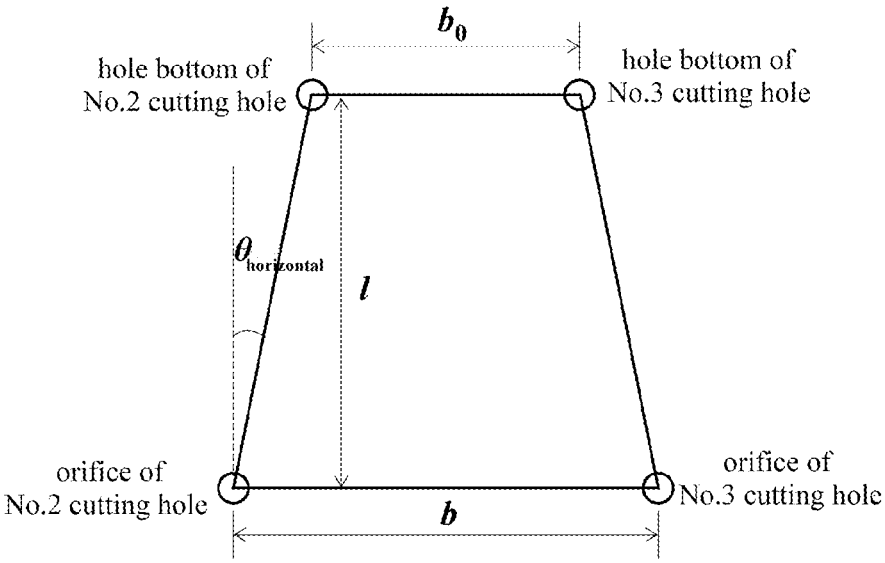
FIG. 19 is a schematic diagram of the borehole inclination angle of the No. 2 cutting hole and the No. 3 cutting hole.

Exemplarily, FIG. 19 shows a schematic diagram of the borehole inclination angle of the No. 2 cutting hole and the No. 3 cutting hole. Due to the inclination angle $\theta_{horizontal}$ of the blast hole drilling is relatively small, the change in the blast hole depth is small, and the blast hole depth is still regarded as l. According to the calculation of the geometric relationship, it is obtained that $$\theta_{horizontal} \geq \arctan\left(\frac{b - b_0}{2l}\right)$$

under critical conditions, the envelopes of the peripheral cracks at the bottom of the two holes are tangent after detonation, and there is still an uncovered range. In order to ensure the effective crushing and throwing of the hole bottom, the center distance of the hole bottom of the No. 2 cutting hole and the No. 3 cutting hole should be less than $b_0$. Correspondingly, the inclination angle of No. 2 cutting hole and No. 3 cutting hole $$\theta_{horizontal} \geq \text{arc tan}\left(\frac{b-b_0}{2l}\right),$$

thus can further improve the cut blasting effect of medium-length hole in high stress rock roadway.

Figure 20:
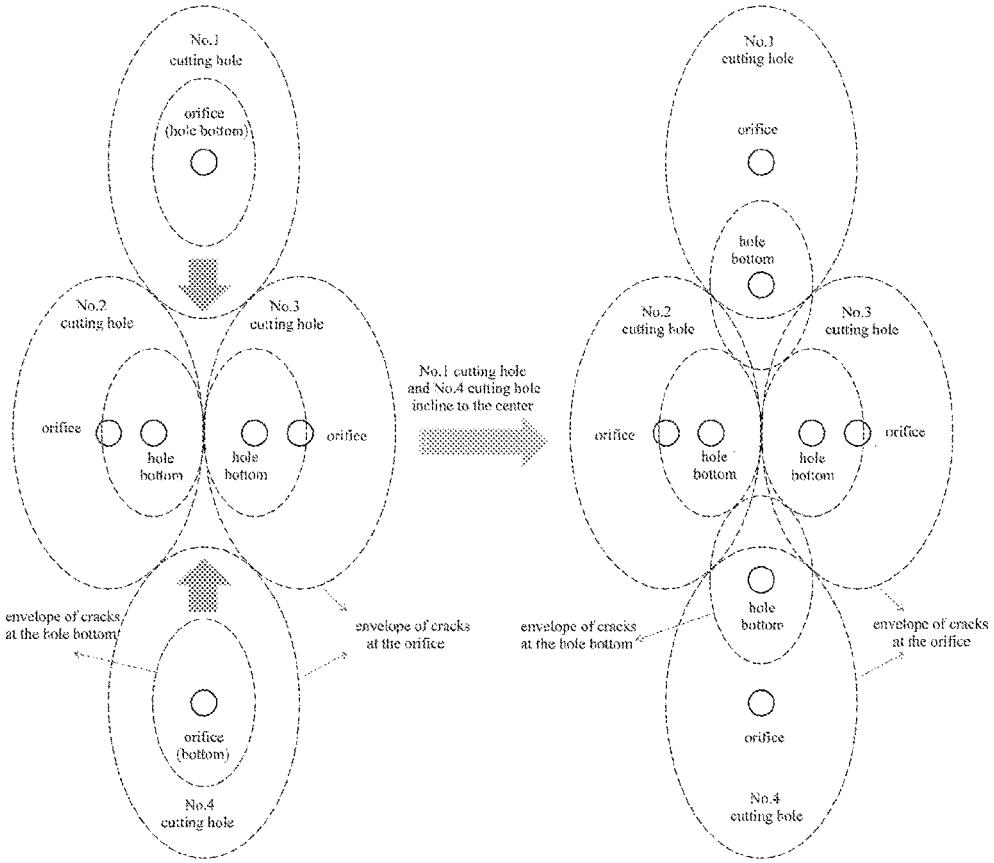
FIG. 20 shows the change in the position of the envelope at the hole bottom when the No. 1 cutting hole and the No. 4 cutting hole are changed from straight holes to oblique holes.

Similarly, the No. 1 and No. 4 cutting holes also need to be in the form of oblique holes, that is, the No. 1 and No. 4 cutting holes are inclined to the center of the cutting area in the vertical arrangement direction. FIG. 20 shows the change in the position of the envelope of the hole bottom when the No. 1 and No. 4 cutting holes are changed from straight to oblique holes. The critical case is the hole bottom envelope of the No. 2 and No. 4 cutting holes are tangent to the hole bottom envelope of the No. 2 and No. 3 cutting holes.

Therefore, in some embodiments, arranging the cutting hole net on the free face of the rock roadway to be excavated according to the crack distribution state further includes: according to the three-dimensional distribution state of the single-hole blasting cracks, determining the vertical offset distance of the center of the crack peripheral envelope on the surface of the free face relative to the center of the peripheral envelope at the hole bottom; based on the vertical offset distance, determining the positions of orifice and hole bottom of the first and fourth cutting holes; based on the determined positions of orifice and hole bottom, drilling the first cutting hole and the fourth cutting hole obliquely from the orifice to the center of the first cutting area, so that the center distance from the center of the hole bottom of the first cutting hole and the fourth cutting hole to the center of the orifice is greater than or equal to the vertical offset distance.

Specifically, the center distance between the hole bottom of the first cutting hole and the hole bottom of the fourth cutting hole is less than or equal to $\sqrt{3}$ times the length of the major axis of the peripheral envelope of the cracks at the hole bottom.

The oblique drilling angle of the first cutting hole and the fourth cutting hole $$\theta_{vertical} \geq \text{arc tan}\left(\frac{\sqrt{3}(a-a_0)}{2l}\right),$$

wherein a is the length of the major axis of the elliptical periphery envelope of the cracks at the orifice, $a_0$ is the length of the major axis of the elliptical periphery envelope of the cracks at the hole bottom, l is the hole depth of the first cutting hole and the fourth cutting hole.

Figure 21:
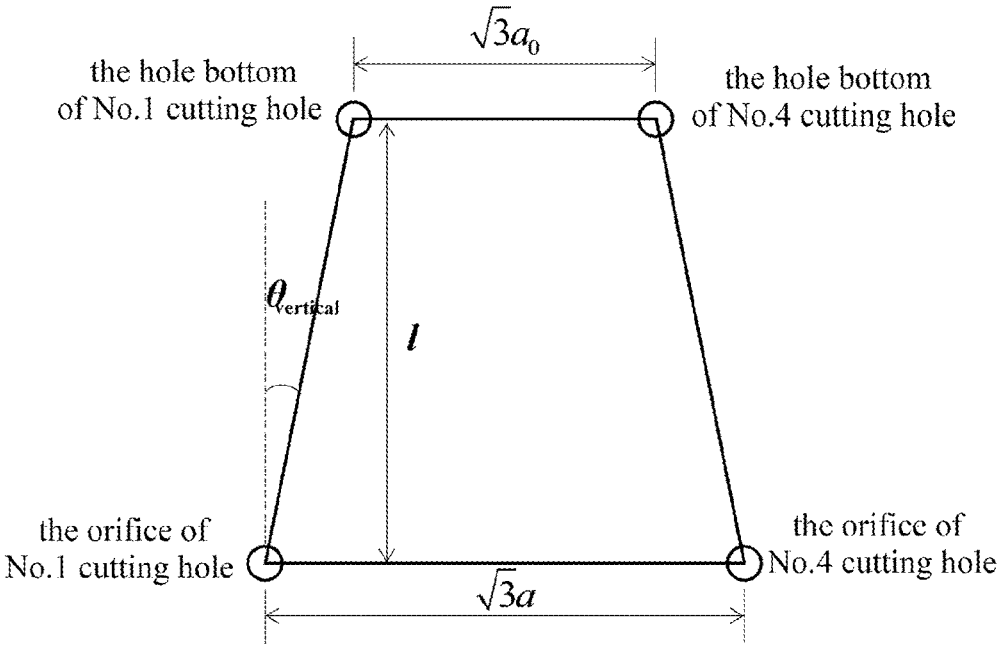
FIG. 21 is a schematic diagram of the borehole inclination angle of the No. 1 cutting hole and the No. 4 cutting hole.

Exemplarily, FIG. 21 shows a schematic diagram of the inclination angle of the No. 1 cutting hole and the No. 4 cutting hole. Since the inclination angle $\theta_{vertical}$ of the blast hole is relatively small, the change of the blast hole depth is small, and the blast hole depth is still regarded as l. According to the calculation of the geometric relationship, it is obtained that under critical conditions, $$\theta_{vertical} \geq \text{arc tan}\left(\frac{\sqrt{3}(a-a_0)}{2l}\right).$$

In order to ensure the effective crushing and throwing of the hole bottom, the hole bottom distance of the No. 1 cutting hole and the No. 4 cutting hole should be smaller than $\sqrt{3}a_0$. Therefore, when the inclination angle of the No. 1 cutting hole and the No. 4 cutting hole $$\theta_{vertical} \geq \text{arc tan}\left(\frac{\sqrt{3}(a-a_0)}{2l}\right),$$

the blasting effect is better.

Similarly, when the number of cutting holes exceeds 4, the drilling inclination direction and inclination angle of the cutting holes are still calculated and determined according to the above-mentioned basic idea, and it will not be repeated.

S130, performing cut blasting based on the cutting hole net.

In order to highlight the innovative gist of the present application, the detonation process will not be repeated.

In this embodiment, by carrying out the cut blasting according to the above-mentioned cutting hole net arrangement in consideration of the crustal stress and the clamping force of rock mass, the effect of the medium-length hole cut blasting in the high stress rock roadway can be improved.

According to the above disclosure, the efficient cut blasting method for medium-length holes in deep high-stress rock roadway based on crustal stress induction effect provided by the embodiments of the present application, when excavating deep high-stress rock roadways based on the drilling and blasting method, the crustal stress blasting test is carried out on the free face of the in-situ rock roadway to be excavated to obtain the crack distribution state under the synergistic action of the crustal stress, the explosion stress waves and the clamping force of surrounding rock of the rock mass in the stratum where the in-situ rock roadway to be excavated is located; according to the distribution state of cracks, a cutting hole net is arranged on the free face of the rock roadway to be excavated; the cut blasting is carried out based on the cutting hole net. In this way, since the crustal stress blasting test is carried out on the free face of the in-situ rock roadway during the arrangement of the cutting hole net, the distribution state of cracks under the synergistic action of the crustal stress, explosion stress waves and clamping force of surrounding rock of the rock mass in the stratum where the in-situ rock roadway is to be excavated are obtained in advance. and the synergistic action of the high crustal stress, the explosive stress waves and the clamping force of the deep-hole rock mass on the blasting cracks in the drilling and blasting excavation engineering of the deep high-stress rock roadway is comprehensively considered. For the medium-length hole cut blasting of deep high-stress rock roadway, the impact effect of crustal stress on rock crushing and throwing is fully considered in the arrangement of cut blasting net. Compared with the current hole net arrangement method of the embodiment that does not comprehensively consider the characteristics of high-stress rock roadway, the effect of medium-length hole cut blasting can be improved.

It should be noted that, herein, the focus of the scheme described between each embodiment is different, but each embodiment has a certain interrelated relationship, in understanding the scheme of the present application, each embodiment may refer to each other; further, in the embodiment of the present application, when states that the technical feature element is fixed on another technical feature element, it may be in direct contact with the surface of another technical feature element, or it can also be another technical feature element that exists in the center. In addition, relational terms such as first and second are only used to distinguish one entity or operation from another, and do not necessarily require or imply any such actual relationship or order between these entities or operations. Further, the term 'including', 'comprises' or any other variation thereof is intended to cover non-exclusive inclusions, so that a process, method, article or platform comprising a series of elements includes not only those elements, but also other elements not expressly listed, or also includes elements inherent in such process, method, article or platform. Without further restrictions, the elements qualified by the statement 'including a . . . ' do not exclude the existence of other identical elements in the process, method, article or table comprising the elements.

The above are only specific embodiments of the present application, but the protection scope of the present application is not limited thereto. Any changes or replacements that can be easily thought of by those skilled in the art within the technical scope disclosed by the present application should be covered within the protection scope of the present application. Therefore, the protection scope of the present application should be subject to the protection scope of the claims.

The invention claimed is:

1. An efficient cut blasting method, comprising:

carrying out a crustal stress blasting test on the free face of an in-situ rock roadway to be excavated, and obtaining a distribution state of cracks under a synergistic action of crustal stress, explosion stress waves and clamping force of surrounding rock of a rock mass in the stratum where the in-situ rock roadway to be excavated is located;

arranging a cutting hole net on the free face of the in-situ rock roadway to be excavated according to the distribution state of cracks;

performing cut blasting based on the cutting hole net;

wherein, the step of carrying out a crustal stress blasting test on the free face of an in-situ rock roadway to be excavated, and obtaining a distribution state of cracks under a synergistic action of crustal stress, explosion stress waves and clamping force of surrounding rock of a rock mass in the stratum where the in-situ rock roadway to be excavated is located includes:

drilling at least one test blast hole with the same depth as that of a cutting hole on the free face of the in-situ rock roadway to be excavated, and the diameter of the test blast hole is the same as that of the cutting hole;

loading explosives in the test blast hole with a charging method and charging amount, and the cutting hole's charging method and charging amount is the same as that of the test blast hole, and inserting a detonator and blocking the blast hole;

detonating the detonator with an igniter and detonating the explosive through the detonator; after the explosion of explosives, the rock mass around the test blast hole is broken and cracks are formed, based on the synergistic action of the explosion stress waves, the deep crustal stress and the clamping force of the surrounding rock around the test blast hole; according to the cracks visible on the surface of the free face, determining the distribution state of the cracks on the rock mass section perpendicular to the axial direction of the blast hole;

the rock mass section perpendicular to the axial direction of the blast hole contains a surface of the free face; the determining the distribution state of the cracks on the rock mass section perpendicular to the axial direction of the blast hole according to the cracks visible on the surface of the free face includes: taking the test blast hole as the center, determining the length of the cracks extending around; using spray paint, marker pen or electronic scanner to connect the end points of the length of the cracks to outline or draw a distribution profile of the cracks on the surface of the free face to form a corresponding peripheral envelope of the cracks;

wherein arranging a cutting hole net on the free face of the in-situ rock roadway to be excavated according to the distribution state of cracks includes: arranging the cutting hole net on the free face of the in-situ rock roadway to be excavated according to a shape and size of the peripheral envelope of the cracks;

the shape of the peripheral envelope of the cracks is an ellipse, and the size of the peripheral envelope of the cracks is represented by its major axis and its minor axis; arranging the cutting hole net on the free face of the in-situ rock roadway to be excavated according to the shape and size of the peripheral envelope of the cracks includes: at least arranging a first group of cutting holes, and at least 4 cutting holes should be arranged in the first group, which are respectively a first cutting hole, a second cutting hole, a third cutting hole and a fourth cutting hole, wherein the hole diameter, hole depth, charging method and charging amount of the first cutting hole, the second cutting hole, the third cutting hole and the fourth cutting hole are the same as that of the test blast hole; according as the peripheral envelope of the cracks after the first cutting hole is detonated, and the peripheral envelope of the cracks after the second cutting hole and the third cutting hole are detonated respectively, have at least a tangent or intersecting part of their shapes respectively, the peripheral envelope of the cracks after the second cutting hole is detonated and the peripheral envelope of the cracks after the third cutting hole is detonated have at least a tangent or intersecting part of their shapes, and the peripheral envelope of the cracks after the fourth cutting hole is detonated and the peripheral envelope of the cracks after the second cutting hole and the third cutting hole are detonated respectively, have at least a tangent or intersecting part of their shapes respectively, and the first cutting hole, the second cutting hole, the third cutting hole and the fourth cutting hole are arranged to form a first cutting area;

the shape of the peripheral envelope of the cracks on the rock mass section upward along the axial direction of the blast hole and perpendicular to the axial direction of the blast hole is consistent; the determining the distribution state of the cracks on the rock mass section perpendicular to the axial direction of the blast hole according to the cracks visible on the surface of the free face further includes: determining the size of the peripheral envelope of the cracks on the rock mass section upward along the axial direction of the blast hole and perpendicular to the axial direction of the blast hole; determining the three-dimensional distribution state of single-hole blasting cracks under the combined effect of crustal stress, explosion stress waves and clamping force of surrounding rock, according to the obtained shape and size of the peripheral envelope of the cracks on the rock mass section upward along the axial direction of the blast hole and perpendicular to the axial direction of the blast hole;

the second cutting hole and the third cutting hole are respectively drilled obliquely to the center of the first cutting area; the center distance from the hole bottom of the second cutting hole to the hole bottom of the third cutting hole is less than or equal to the minor axis length of the peripheral envelope of the cracks at the hole bottom of the second cutting hole and the third cutting hole;

the center distance from the hole bottom of the first cutting hole to the hole bottom of the fourth cutting hole is less than or equal to $\sqrt{3}$ times of the major axis length of the peripheral envelope of the cracks at the hole bottom of the first cutting hole and the fourth cutting hole.

2. The method according to claim 1, characterized in that, the first cutting hole and the fourth cutting hole are symmetrically arranged with respect to the center line connecting the second cutting hole and the third cutting hole.

3. The method according to claim 2, characterized in that, the center distance between the first cutting hole and the fourth cutting hole $l_1 \leq \sqrt{3}a$, the center distance between the second cutting hole and the third cutting hole $l_2 \leq b$, wherein the center distance between the first cutting hole and the second cutting hole, the center distance between the first cutting hole and the third cutting hole, the center distance between the second cutting hole and the fourth cutting hole, the center distance between the third cutting hole and the fourth cutting hole all must satisfy $$l_3 \leq \frac{\sqrt{3a^2 + b^2}}{2},$$

wherein a is the major axis length of the peripheral envelope of the cracks on the surface of the free face, and b is the minor axis length of the peripheral envelope of the cracks on the surface of the free face.

4. The method according to claim 1, characterized in that, arranging the cutting hole net on the free face of the in-situ rock roadway to be excavated according to the distribution state of cracks further includes:

according to the three-dimensional distribution state of the single-hole blasting cracks determining the horizontal offset distance of the center of the peripheral envelope of cracks on the surface of the free face relative to the center of the peripheral envelope at the hole bottom of cutting holes;

based on the horizontal offset distance, determining the positions of orifice and hole bottom of the second and third cutting holes;

based on the determined positions of orifice and hole bottom of the second and third cutting holes, drilling the second cutting hole and the third cutting hole obliquely from the orifice of the second cutting hole and the third cutting hole, so that the center distance from the center of the hole bottom of the second cutting hole and the third cutting hole to the center of the orifice of the second cutting hole and the third cutting hole is greater than or equal to the horizontal offset distance.

5. The method according to claim 1, characterized in that, the second cutting hole and the third cutting hole are obliquely drilled at an angle $$\theta_{horizontal} \geq \arctan\left(\frac{b - b_0}{2l}\right),$$

wherein b is the center distance between the orifice of the second cutting hole and the orifice of the third cutting hole, $b_0$ is the center distance between the hole bottom of the second cutting hole and the hole bottom of the third cutting hole, and l is the hole depth of the second cutting hole and the third cutting hole.

6. The method according to claim 1, characterized in that, arranging the cutting hole net on the free face of the in-situ rock roadway to be excavated according to the distribution state of cracks further includes:

according to the three-dimensional distribution state of the single-hole blasting cracks, determining the vertical offset distance of the center of the crack peripheral envelope on the surface of the free face relative to the center of the peripheral envelope at the hole bottom of cutting holes;

based on the vertical offset distance, determining the positions of orifice and hole bottom of the first and fourth cutting holes;

based on the determined positions of orifice and hole bottom of the first and fourth cutting holes, drilling the first cutting hole and the fourth cutting hole obliquely from the orifice of the first cutting hole and the fourth cutting hole to the center of the first cutting area, so that the center distance from the center of the hole bottom of the first cutting hole and the fourth cutting hole to the center of the orifice of the first cutting hole and the fourth cutting hole is greater than or equal to the vertical offset distance.

7. The method according to claim 1, characterized in that, the first cutting hole and the fourth cutting hole are obliquely drilled at an angle $$\theta_{vertical} \geq \arctan\left(\frac{\sqrt{3}\,(a - a_0)}{2l}\right),$$

wherein a is the major axis length of the periphery envelope of the elliptical crack at the orifice, $a_0$ is the major axis length of the periphery envelope of the elliptical crack at the hole bottom, l is the hole depth of the first cutting hole and the fourth cutting hole.

* * * * *